US009863185B2

(12) United States Patent
Franssen

(10) Patent No.: US 9,863,185 B2
(45) Date of Patent: Jan. 9, 2018

(54) RETRACTABLE COVERING

(71) Applicant: Hunter Douglas Industries B.V., Rotterdam (NL)

(72) Inventor: Johannes Robertus Maria Franssen, Breda (NL)

(73) Assignee: HUNTER DOUGLAS INDUSTRIES BV, Rotterdam (NL)

( * ) Notice: Subject to any disclaimer, the term of this patent is extended or adjusted under 35 U.S.C. 154(b) by 101 days.

(21) Appl. No.: 14/380,541

(22) PCT Filed: Feb. 27, 2013

(86) PCT No.: PCT/NL2013/000011

§ 371 (c)(1),
(2) Date: Aug. 22, 2014

(87) PCT Pub. No.: WO2013/129932

PCT Pub. Date: Sep. 6, 2013

(65) Prior Publication Data

US 2015/0020980 A1 Jan. 22, 2015

(30) Foreign Application Priority Data

Feb. 28, 2012 (NL) ..... 2008370

(51) Int. Cl.
*A47H 5/00* (2006.01)
*E06B 3/48* (2006.01)
(Continued)

(52) U.S. Cl.
CPC ..... *E06B 9/322* (2013.01); *E06B 9/382* (2013.01); *E06B 9/388* (2013.01)

(58) Field of Classification Search
CPC ..... E06B 9/322; E06B 9/382; E06B 9/388; E06B 9/30; E06B 9/326; E06B 9/384; E06B 9/324; E06B 2009/3222
See application file for complete search history.

(56) References Cited

U.S. PATENT DOCUMENTS 6,059,004 A * 5/2000 Oskam ..... E06B 9/262 160/166.1
6,085,823 A * 7/2000 Oskam ..... E06B 9/323 160/172 R (Continued)

FOREIGN PATENT DOCUMENTS

EP 0892144 A2 1/1999
NL WO 2011128028 A2 * 10/2011 ..... E06B 9/322

OTHER PUBLICATIONS

PCT International Search Report dated Jun. 11, 2013 for International Application No. PCT/NL2013/000011, 4 pages.

*Primary Examiner* — Katherine Mitchell
*Assistant Examiner* — Jeremy Ramsey
(74) *Attorney, Agent, or Firm* — Dority & Manning, P.A.

(57) ABSTRACT

A retractable covering such as a door or window blind or shade has a top rail, a bottom rail, a covering material extending between the top rail and the bottom rail, at least two lift cords extending downwardly from the head rail to the bottom rail for supporting the bottom rail, a covering operating system for enabling retraction and deployment of the covering, and an adjuster connected to at least two of the lift cords. The adjuster is preferably mounted in the bottom rail. The retractable covering also comprises an individual cord tensioner for allowing at least one of the lift cords to be individually tensioned. The individual cord tensioner operates independently of the adjuster. A method of adjusting the orientation and drop height of the bottom rail of the retractable covering is also provided.

17 Claims, 3 Drawing Sheets

(51) Int. Cl.

| | |
|---|---|
| ***E06B 3/94*** | (2006.01) |
| ***E06B 9/06*** | (2006.01) |
| ***E06B 9/322*** | (2006.01) |
| ***E06B 9/382*** | (2006.01) |
| ***E06B 9/388*** | (2006.01) |

(56) References Cited

U.S. PATENT DOCUMENTS

| | | | | |
|---|---|---|---|---|
| 6,095,222 | A * | 8/2000 | Voss | E06B 9/262 160/84.05 |
| 6,550,522 | B1 * | 4/2003 | Lennon | E06B 9/367 160/168.1 R |
| 7,108,038 | B2 * | 9/2006 | Welfonder | E06B 9/322 160/172 R |
| 2007/0068636 | A1 * | 3/2007 | Yu | E06B 9/322 160/168.1 R |
| 2013/0192774 | A1 * | 8/2013 | Lin | E06B 9/322 160/340 |
| 2013/0333849 | A1 * | 12/2013 | Kirby | E06B 9/388 160/331 |
| 2014/0262079 | A1 * | 9/2014 | Filko | E06B 9/322 160/311 |

* cited by examiner

RETRACTABLE COVERING

CROSS-REFERENCE TO RELATED APPLICATIONS

This application is the national stage application of International Patent Application No. PCT/NL2013/000011, filed Feb. 27, 2013, entitled "A Retractable Covering", which claims priority to Netherlands Patent Application No. 2008370, filed Feb. 28, 2012, entitled "A Retractable Covering", which are hereby incorporated by reference herein in their entireties.

BACKGROUND OF THE INVENTION

This invention relates to a retractable covering, particularly a covering for an architectural opening, such as a window or a door blind or shade.

Conventional, blinds and shades for windows and doors include a head rail, a bottom rail, one or more window covering elements extending between the head rail and the bottom rail, at least two lift cords extending from the head rail and supporting the bottom rail, and a mechanism to limit the downward movement or drop of the bottom rail.

For pleated or roman shades, the drop height of the shades has usually been limited by a cord connector, engaging the cord outlet at the bottom of the head rail upon full drop of the bottom rail. Sometimes pleated and roman shades have also been provided with an additional cord to limit drop. On the other hand, for venetian blinds the full drop has usually been limited by the full extension of the lift cords.

Limiting drop without additional cords by making use of the lift cord has presented obvious advantages because fewer elements are used in assembling the blinds or shades.

Experience has shown, however, that providing the proper lengths of the lift cords between the head rail and the bottom rail for controlling drop has not been easy.

Conventional shades have had a minimum of two lift cords co-extending through the shade members and holding the bottom rail at several locations based along its length. The free ends of these lift cords have extended through the head rail to an exit opening or cord lock in one of its longitudinal ends, and the free ends have optionally been joined or knotted together in a cord connector outside the head rail.

Accurate adjustment of drop is important because the bottom rail should not hit the windowsill or floor nor should it be suspended too high so that an unsightly gap exists between the bottom rail and the windowsill or floor. However, it is not easy to precisely set the drop by adjusting the final location of a knot along the lift cords, at least prior to making the knot.

Our European patent EP 0 892 144 describes an adjuster which is connected to the lower end of the lift cords and which allows for fine adjustment of the maximum drop height of the bottom rail. This adjuster allows all the lift cords which are connected to it to be adjusted simultaneously. The adjuster can be readily operated by an end user and thereby allows the maximum drop height of the bottom rail to be adjusted after installation without the need for calling out a professional installer. The disclosure of EP 0 892 144 is incorporated herein in its entirety.

SUMMARY

The present invention aims to provide an improved retractable covering.

According to this invention, there is provided a retractable covering comprising:

a head rail;

a bottom rail;

a covering material, connected to the bottom rail;

at least two lift cords extending downwardly from the head rail to the bottom rail for supporting the bottom rail;

a covering operating system for enabling raising and lowering of the bottom rail; and an adjuster connected to at least two of the lift cords, the adjuster being mounted in the bottom rail;

characterized in that an individual cord tensioner is provided for at least one of the lift cords, the individual cord tensioner being operable independently of the adjuster.

The individual cord tensioner may be located in any one of the rails.

It is desirable that at least two lift cords extend between the covering operating system and the adjuster, and the individual cord tensioner is located between the covering operating system and the adjuster.

Advantageously, the individual cord tensioner is readjustable. This allows the effective length of the lift cord to be adjusted as and when desired by a user post-installation.

Preferably all of the lift cords are connected to the adjuster.

Preferably all but one of the lift cords are provided with an individual cord tensioner. Alternatively, all of the lift cords may be provided with an individual cord tensioner. The individual cord tensioner preferably comprises a clamp which holds the cord at the desired tension. Alternatively the individual cord tensioner may comprise a slider which is manually movable along one of the rails, and which is attached to the lift cord, and a clamp may be provided on the slider to hold the slider at a desired location on the rail. The slider advantageously permits the cord to move in relation to the slider when the slider is in an unclamped state.

The covering operating system for enabling retraction and deployment of the covering may be a cord lock system. Alternatively, the covering operating system may be a rotatable shaft and pulley system, wherein the lift cords are wound on and unwound from pulleys.

The present invention also provides a method of adjusting the orientation and drop height of the bottom rail of the retractable covering as described above, comprising the steps of:

individually tensioning each of the individual cord tensioners provided; and using the adjuster to determine the drop height of the bottom rail.

BRIEF DESCRIPTION OF THE DRAWINGS

The present invention will now be described with reference to the accompanying drawing of which

DETAILED DESCRIPTION

Figure 1:
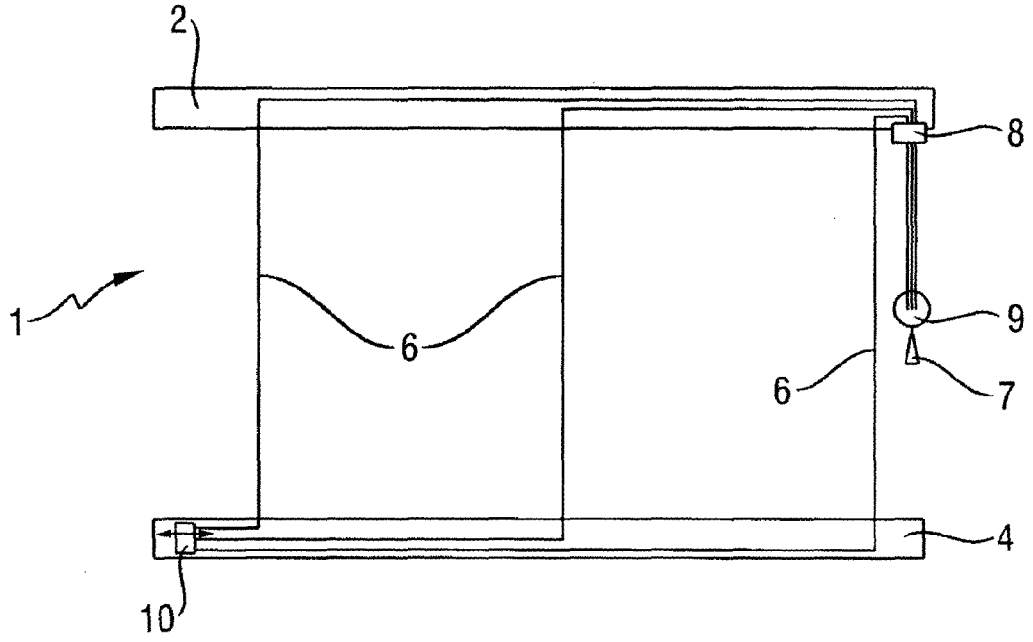
Figure 1 PRIOR ART
FIG. 1 shows a schematic representation of the known window blind described in the European patent EP 0 892 144.

FIG. 1 shows a window blind 1 having a head rail 2 and a bottom rail 4. A shade fabric (not shown for clarity) extends between the head rail 2 and the bottom rail 4. Three lift cords 6 are provided for supporting the fabric, for raising and lowering the blind 1 and for supporting the bottom rail 4. The lift cord 6 also serves to limit the drop of the bottom rail 4. The lift cords 6 pass over conventional guide means in the head rail 2 and then out of the bottom of the head rail 2 through a cord lock 8. The cords are then connected by a conventional connector 9, from which a tassel 7 extends. A user can raise or lower the blind by pulling on the tassel 7.

The connector 9 also serves to limit the drop height of the blind 1 by limiting the downward movement of the bottom rail 4. In this regard, the connector 9 engages the cord lock 8 at the limit of the drop height, whereby the connector 9 cannot go outwardly any further and as a result, the bottom rail cannot go downwardly any further. This method of raising and lowering the blind is well known in the art and is referred to as a cord lock system.

The bottom ends of the three cords 6 each pass through a separate opening (not shown) in the top surface of the bottom rail 4, and each cord is connected to adjuster 10. The adjuster 10 may be for example the adjuster described in European patent EP 0 892 144. Once they have passed through the adjuster 10 the lift cords 6 are knotted together in a conventional manner to approximately set the drop length of the bottom rail 4. The adjuster 10 can then be used to permit fine adjustment of the maximum drop height of the bottom rail 4. The adjuster is further described with reference to FIG. 5.

From FIG. 1 it can be seen that all of the lift cords 6 have the same initial length. During the lifetime of a window covering, the lift cords may shrink or elongate, depending on the ambient conditions (humidity, temperature, etc.) to which they are exposed. When all the cords 6 have the same initial length, it is assumed that their change in length will be identical as well (assuming that the cords are exposed to the same ambient conditions). This in turn will assure that the bottom rail will maintain the same orientation. This means that once the rail is levelled horizontally, during initial installation, it will maintain this horizontal orientation regardless of whether or not the cords shrink or become elongated. During operation of the adjuster, the bottom rail 4 will also maintain its orientation.

Figure 2:
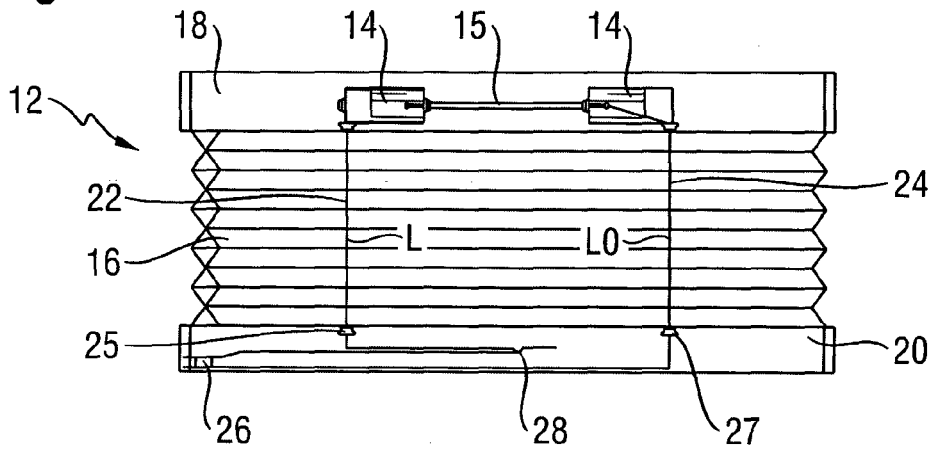
FIG. 2 shows a schematic view of a retractable covering for a door or window in accordance with the present invention.

FIG. 2 shows a window blind 12 in accordance with the present invention. The blind 12 is in a fully extended state and comprises a head rail 18, a bottom rail 20 and a fabric 16 which extends between the head rail 18 and the bottom rail 20. In this example, a cord lock system is not used to extend and deploy the shade fabric 16. It will be recognized however that the cord lock system could be used with the present invention. Instead, FIG. 2 shows an operating system of the pulley and rotatable shaft type. To retract or extend the blind, the lift cords are wound on respective pulleys 14. The pulleys are mounted on a rotatable shaft 15. The rotatable shaft 15 can be rotated by various conventional means (such as a wand and a suitable gear transmission, or a motor, or a ball chain, or a short pull cord with a ratchet mechanism that allows the pull cord to be pulled downward repetitively thereby driving the shaft, etc.). The shaft operating system is not shown here in its entirety for clarity.

Lift cords 22, 24 extend from the covering operating system (in this case pulleys 14) through the fabric 16 and into the bottom rail 20. Holes 25, 27 are provided in the top surface of the bottom rail 20, for receiving the lift cords 22, 24.

The lift cords 22, 24 extend through the bottom rail and are connected to adjuster 26. Adjuster 26 may be of the type described in European patent 0 892 144. An individual cord tensioner 28 is provided in the bottom rail 20. Cord 22 extends from the pulley 14 through the fabric 16 into the bottom rail 20 where it is connected to the individual cord tensioner 28 before being connected to adjuster 26. It can be seen that lift cord 24 in this example is not provided with an individual cord tensioner.

In use the rotatable lift shaft 15 and associated pulleys 14 act to raise and lower the bottom rail 20 of the blind 12. During installation, or at any time subsequent to installation, individual cord tensioner 28 is used to apply tension to the lift cord 22. This effectively shortens the effective length L of the lift cord 22. Using the individual cord tensioner 28, lift cord 22 may be adjusted until its effective length L is the same as the effective length L0 of lift cord 24. This is achieved when the bottom rail 20 has a horizontal orientation, without an unsightly slant. Once this is achieved, adjuster 26 can be used, as described in EP 0 892 144, to achieve fine adjustment of the maximum drop height of the bottom rail 20. The bottom rail 20 should now be substantially horizontal, and its drop length should be correct for the window or door which it is covering. The user may now retract or deploy the window blind 12 using the pulley and rotatable shaft operating system as desired. If the user desires a different drop length for the window blind 12, or if the lift cords 22, 24 become shorter or longer with time, or if the bottom rail 20 loses its horizontal orientation, the window blind may be adjusted as described above by a user, without the need to call out a professional installer.

Figure 3:
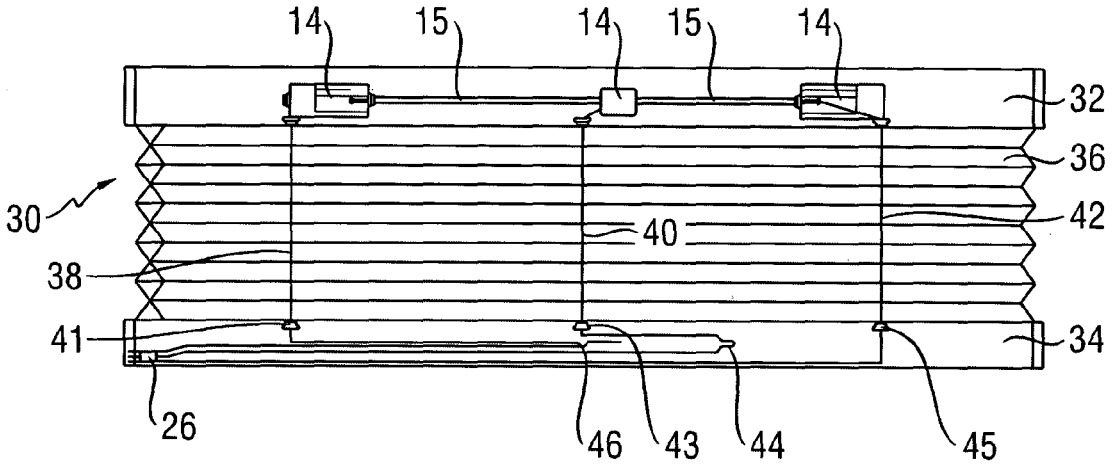
FIG. 3 shows a schematic view of another retractable covering for a door or a window in accordance with the present invention.

FIG. 3 shows another window blind 30 in accordance with the present invention. Window blind 30 comprises a top rail 32, a bottom rail 34, and a shade fabric 36 which extends between the top rail 32 and the bottom rail 34. It can be seen that window blind 30 is wider than window blind 12 of FIG. 2. To enable support of the bottom rail 34, the fabric 36, and to enable deployment of the blind 30, three lift cords 38, 40, 42 are provided. Each of the lift cords is connected to a pulley 14. The pulleys 14 are mounted on a rotatable shaft 15 and operate as described with respect to FIG. 2. The lower end of the lift cords 38, 40, 42 pass through respective holes 41, 43, 45 in the top surface of the bottom rail 34. Lift cord 38 passes through hole 41 and is then attached to individual cord tensioner 46 before being connected to adjuster 26. Similarly, lift cord 40 passes through hole 43 and is then attached to individual cord tensioner 44 before being connected to adjuster 26. Lift cord 42 is not provided with an individual cord tensioner but instead passes through hole 45 and is connected directly to the adjuster 26.

During installation, or subsequent adjustment of the window blind 30, the window blind 30 is adjusted in a similar manner to window blind 12. Lift cord 38 is adjusted by means of individual cord tensioner 46 and lift cord 40 is adjusted by means of individual cord tensioner 44 such that all the lift Cords 38, 40 and 42 have the same effective length L. Adjuster 26 is then used to control the drop height of window blind 30.

Figure 4:
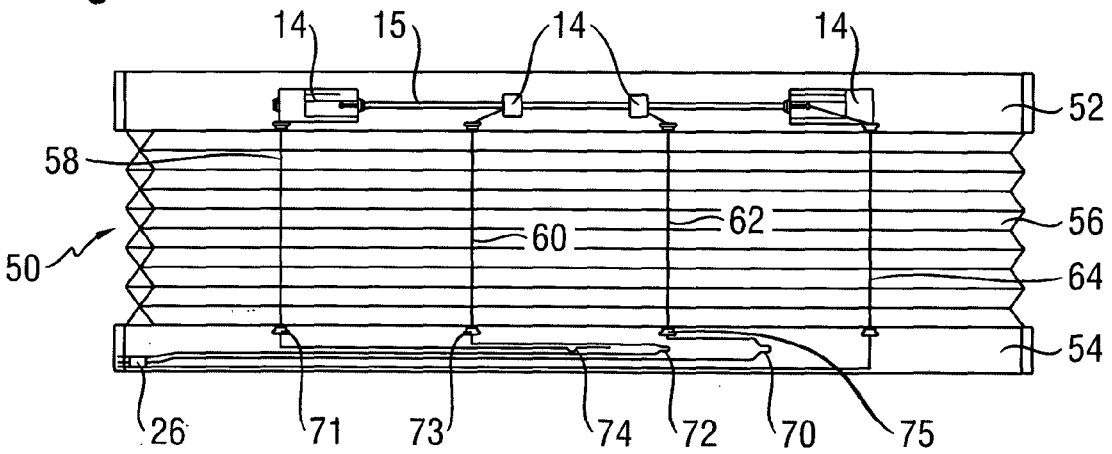
FIG. 4 shows a schematic representation of yet another retractable covering for a door or a window in accordance with the present invention.

FIG. 4 shows another window blind 50 in accordance with the present invention. Window blind 50 is similar to window blinds 12 and 30 of FIGS. 2 and 3, respectively, in that it comprises a head rail 52, a bottom rail 54, and a shade fabric 56 extending between the head rail 52 and the bottom rail 54. Again, a user can retract or deploy the blind 50 using the pulleys 14 and rotatable shaft 15 operating system. In this example, the blind has four lift cords 58, 60, 62 and 64. Lift cord 58 passes through hole 71 in the top surface of the bottom rail 54 and is attached to individual cord tensioner 74 before being connected to adjuster 26. Similarly, lift cord 60 passes through hole 73 before being attached to individual cord tensioner 72 and finally being connected to adjuster 26. Again, lift cord 62 passes through hole 75 and is attached to individual cord tensioner 70 before being connected to adjuster 26. Lift cord 64 is connected directly to the adjuster 26 and does not have an individual cord tensioner.

In use the individual cord tensioners 74, 72 and 70 may be operated by the user to ensure that the total length and/or effective length L of the four lift cords 58, 60, 62 and 64 are the same. The adjuster 26 is then used to precisely set the drop height of the window blind 50.

Figure 5:
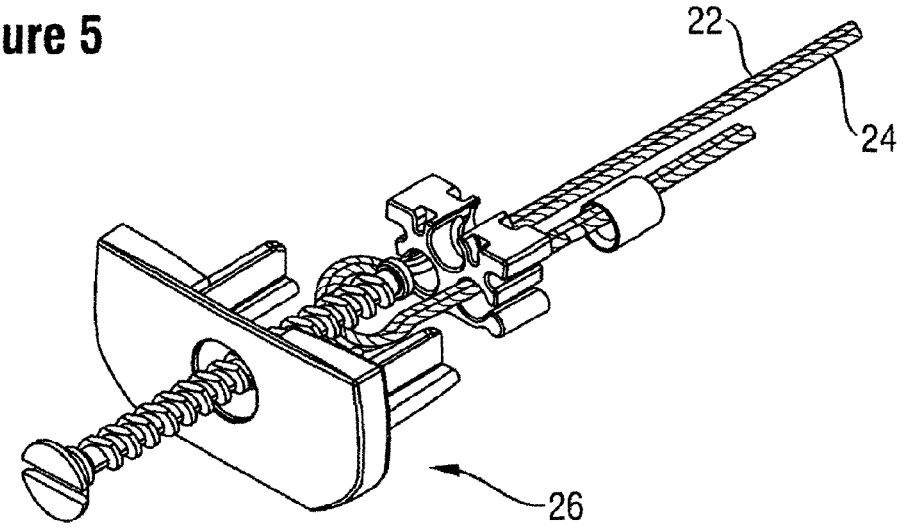
FIG. 5 is an exploded perspective view of an adjuster suitable for use with the present invention.

FIG. 5 shows an adjuster 26 suitable for use in the present invention. Adjuster 26 is described in patent EP 0 892 144 which is herein incorporated by reference. In FIG. 5, two lift cords 22, 24 are shown connected to adjuster 26. Of course, adjuster 26 may be adapted to receive three, four or more lift cords as desired. Adjuster 26 allows all of the lift cords attached to it to be adjusted simultaneously. This allows the drop height of a blind to be set rapidly and accurately by a non-professional user.

Figure 6:
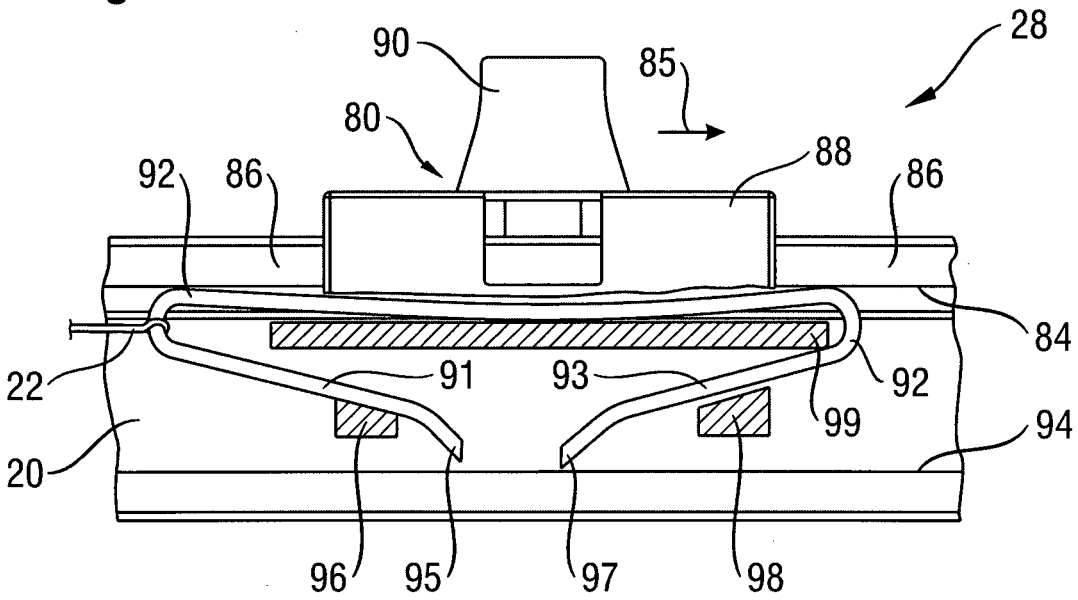
FIG. 6 is a plan view, partly in section, of part of a bottom rail of a retractable covering and shows an individual cord tensioner in accordance with a first embodiment of the present invention.

FIG. 6 shows an individual cord tensioner 28. The individual cord tensioner 28 comprises a slider 80 which is manually movable longitudinally along the bottom rail 20, and a locking mechanism or clamp 92 which is attached to the slider 80 and acts to hold the slider at a desired longitudinal location on the bottom rail 20 which corresponds to a desired tension of the lift cord 22.

The slider 80 is adapted to slide longitudinally along a flange 86 in the bottom rail 20. The slider 80 comprises a sliding portion 88, 99 and a handle 90. In this example, clamp 92 is a bent spring wire clamp and it is attached to and/or retained by the sliding portion 88, 99 of the slider 80. The clamp 92 is disposed in groove 84. Groove 84 extends longitudinally along the bottom rail 20. Sliding portion 88 is retained by flange 86 and is free (when in an unclamped state) to slide along the longitudinal length of bottom rail 20. Clamp 92 is attached to and/or retained by sliding portion 88, 99 of slider 80 and acts to retain the slider 80 in a desired position along the longitudinal length of the bottom rail 20. Handle 90 is provided to allow the user to readily slide the slider 80 along the bottom rail 20 and thereby tension the lift cord 22. The lift cord 22 is looped around the clamp 92 so that when slider 80 is moved in a direction of the arrow 85 the lift cord 22 is tensioned, and when the slider 80 is moved in the opposite direction to the arrow 85, the lift cord 22 is relaxed. The clamp 92 has sprung legs 91 and 93, respectively. The legs 92 and 93 have slanted or chamfered ends 95 and 97, respectively. The chamfered ends 95, 97 form sharp edges which are in sliding abutting relationship to the surface of flange 94. When the chamfered ends 95, 97 of legs 91, 93 make contact with surface 94, the clamp 92 acts to prevent the slider 80 from freely sliding along the bottom rail 20 and thereby holds the individual cord tensioner 28 in a desired position on the bottom rail 20. The slider 80 also comprises ramp surfaces 96, 98. Each ramp surface 96, 98 abuts, and can engage, one of the legs 91, 93 of the clamp 92.

In use, in order to tension the lift cord 22, the slider 80 is moved manually in the direction of the arrow 85. This causes the slider 80 and its ramp surface 96, abutting the left-hand leg 91 of the clamp 92, to move initially relative to the spring wire clamp 92 whereby ramp surface 96 puts pressure on the spring leg 91 so that the sharp edge 95 is pushed away from the surface 94. Continued movement in the direction of the arrow 85 will allow the whole slider 80 and clamp assembly 92 to move in a direction of the arrow 85, the other sharp edge 97 on the end of the right-hand leg 93 being moved in a direction away from its gripping action along the surface 94 of the bottom rail 20. When the lift cord 22 is at the desired tension, the user simply releases the handle 90 of the slider 80. The slider 80 will move back slightly to the left due to the action of the relaxing spring wire clamp 92. Tension in the lift cord 22 will tend to pull the clamp 92 back to the left, but the sharp edge 97 of the right-hand leg 93 of the clamp 92 and to a lesser extent its other sharp edge 95 of the left-hand leg 91, which edges are now both in contact with the surface 94 of the bottom rail 20, will prevent any further movement of the clamp 92 and slider 80. The clamp 92 thereby provides a self-locking feature for the slider 80, locking the slider 80 and the lift cord 22 at a desired location on the bottom rail 20.

Figure 7:
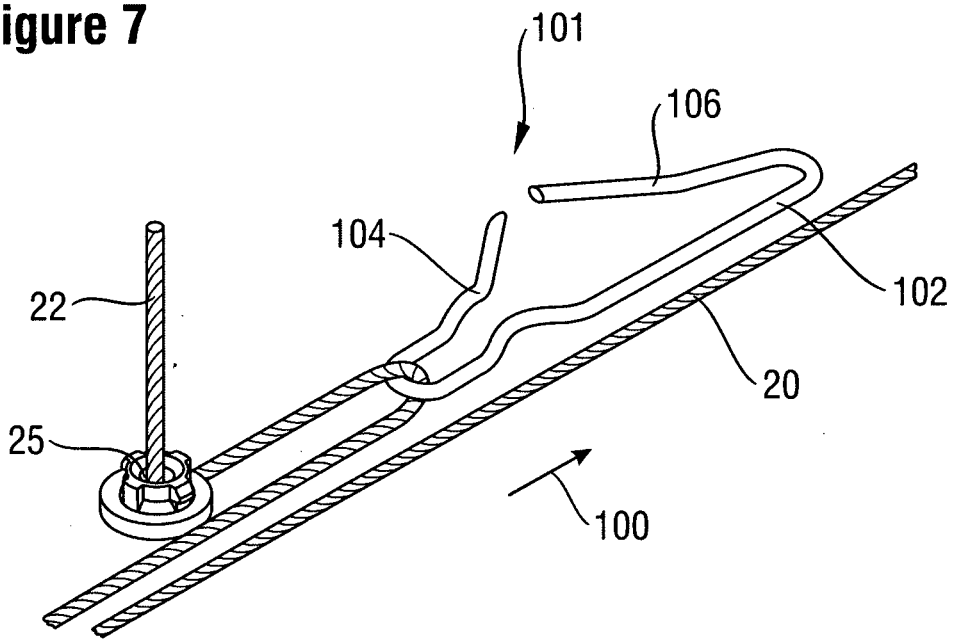
FIG. 7 shows a schematic diagram of an individual cord tensioner in accordance with a second embodiment of the present invention.

FIG. 7 illustrates a simpler embodiment of the invention and shows an individual cord tensioner 101 which comprises a clamp 102 disposed in rail 20. Clamp 102 is a bent spring wire clamp and is similar to the spring wire clamp described with respect to FIG. 6. However, in this second embodiment, the clamp is not provided with a slider. Instead the clamp is moved manually by the user. The lift cord 22 is looped around the wire clamp 102 so that when the user moves the clamp in a direction of the arrow 100 the lift cord 22 is tensioned, and when the clamp 102 is moved in the opposite direction to the arrow 100, the lift cord 22 is relaxed. The clamp 102 has sprung legs 104 and 106, respectively. The legs 104 and 106 may have slanted or chamfered ends which form sharp edges to aid the clamp 102 in gripping the rail 20, thereby holding the individual cord tensioner 101 in a desired position on the bottom rail 20. It can be seen that lift cord 22 extends through hole 25 in the lower rail and then loops around leg 104 of clamp 102. The lift cord 22 can be tensioned by moving the clamp 102 in the direction of the arrow 100. Once the desired position is reached, the user releases the clamp 102 which then remains in place on the bottom rail, thereby maintaining the desired tension in the lift cord 22.

Each lift cord may be provided with its own individual cord tensioner 28, 101 as described above.

It will be appreciated that the present invention allows a non-professional user to accurately control the orientation and position of the bottom rail of a blind, shade or other retractable covering incorporating the invention. The effective length of each of the lift cords may be individually set by using the individual cord tensioners, and may be readjusted as necessary. This allows a user to regularly ensure that the bottom rail maintains a horizontal position and that the bottom rail is equally supported by all of the lift cords. Once this has been achieved, the adjuster can be used to rapidly and accurately adjust the drop height of the bottom rail.

Although the present invention has been described with respect to coverings of the rotatable shaft and pulley system type, it may also be beneficially incorporated, for example, in retractable coverings of the cord lock system type. In such covering types, the respective lift cords may be of identical length, as will be clear from FIG. 1. This is beneficial, because such identical lengths may have identical shrinkage or elongation behaviour, which will help to keep the bottom rail levelled horizontally. However, if one desires to position the adjuster at another location along the bottom rail, the cords would no longer have the same length. A user may for instance desire to have the pull tassel and the adjuster at the same end of the covering, for example, in case where the other end of the covering is not so easily accessible. With the individual cord tensioners according to the invention, all cords can be made of identical length. Surplus length can be simply taken up by the individual cord tensioners, by moving the cord tensioners to an appropriate position along the rail.

Incorporating an individual cord tensioner would allow the cords to have different lengths, which would permit the adjuster to be positioned at any location along the bottom rail.

As shown in the figures, the invention may also be beneficially incorporated in retractable coverings of the rotatable shaft and pulley system type. Typically, known coverings of this type are provided with several lift cords which may or may not be of the same length. The orientation of the bottom rail and the maximum drop height of the covering are set by individually adjusting each of the lift cords, for example, by tying the lift cord in a fixed position within the bottom rail or by providing a knot to prevent the lift cord from passing through a hole in the bottom rail. This is time consuming and difficult for a non-professional user to do whilst maintaining the bottom rail in a substantially horizontal orientation.

The present invention allows a user to easily tension each lift cord by using the individual cord tensioners and then adjust the drop height of the covering by using the adjuster, which permits simultaneous adjustment of all the lift cords. This represents a significant improvement in adjustability of this type of covering.

It will further be recognized that, although it is not necessary to provide lift cords of identical length, this is beneficial as during the lifetime of the covering the lift cords may shrink or elongate, depending on the humidity, temperatures and other ambient conditions to which they are exposed. If all the lift cords have the same initial length, it is expected that their change in length will be identical as well, thereby reducing the amount of readjustment necessary to the benefit of the user.

The present invention allows lift cords of the same or dissimilar lengths to be provided for different types of coverings, including those of a rotatable shaft and pulley system type, and a cord lock system type, whilst permitting the user to make easy and rapid adjustments to the orientation and drop height of the covering.

The skilled reader will also be aware that although a particular type of adjuster is described in the examples, any other adjusters, which fulfil the same function as the adjuster described with reference to the figures, may be used instead.

Similarly, it will be recognized that cord tensioners of a modified or a different type to those shown in the examples may be used instead.

The invention claimed is:

1. A retractable covering comprising:

a head rail;

a bottom rail;

a covering material connected to the bottom rail;

at least two lift cords extending downwardly from the head rail to the bottom rail for supporting the bottom rail;

a covering operating system for enabling raising and lowering of the bottom rail;

an adjuster configured to adjust a drop height of the covering, the adjuster being mounted in the bottom rail; and one or more cord tensioners, an individual cord tensioner of the one or more cord tensioners provided for at least one of the lift cords for setting an effective length of the at least one of the lift cords, the one or more cord tensioners being operable independently of the adjuster, wherein:

fewer than all of the lift cords are provided in operative association with an individual cord tensioner of the one or more cord tensioners; and the at least two cords are connected to the adjuster.

2. A retractable covering as claimed in claim 1, wherein the one or more cord tensioners are located in one of the head or bottom rails.

3. A retractable covering as claimed in claim 1, wherein the lift cords extend between the covering operating system and the adjuster, and the one or more cord tensioners are located between the covering operating system and the adjuster.

4. A retractable covering as claimed in claim 1, wherein the one or more cord tensioners are readjustable.

5. A retractable covering as claimed in claim 1, wherein all but one of the lift cords are provided with an individual cord tensioner of the one or more cord tensioners.

6. A retractable covering as claimed in claim 1, wherein the one or more cord tensioners comprise a clamp.

7. A retractable covering as claimed in claim 1, wherein the one or more cord tensioner comprise a slider which is manually movable along one of the rails, and which is attached to the at least one of the lift cords, and a clamp provided on the slider to hold the slider at a desired location on the rail, the slider permitting the at least one of the lift cords to move in relation to the slider when the slider is in an unclamped state.

8. A retractable covering as claimed in claim 1, wherein the covering operating system for enabling retraction and deployment of the covering comprises a cord lock system.

9. A retractable covering as claimed in claim 1, wherein the covering operating system comprises a rotatable shaft and pulley system.

10. A retractable covering as claimed in claim 1, wherein:

the covering operating system comprises a rotatable shaft and a plurality of pulleys each rotatably mounted on the rotatable shaft; and each lift cord is wrapped about a respective pulley when the covering is in a retracted configuration.

11. A retractable covering as claimed in claim 1, wherein:

the covering operating system comprises a rotatable shaft and pulley system; and the lifts cords extend from the covering operating system to the adjuster.

12. A method of adjusting the orientation and drop height of a bottom rail of a retractable covering, comprising:

tensioning one or more cord tensioners, an individual cord tensioner of the one or more cord tensioners provided for at least one of two or more lift cords extending downwardly from a head rail to a bottom rail, the one ore more cord tensioners operable to set an effective length of the at least one of the lift cords; and using an adjuster connected to the lift cords and mounted in the bottom rail to determine the drop height of the bottom rail;

wherein:

the one or more cord tensioners are operable independently of the adjuster; and fewer than all of the lift cords are provided in operative association with an individual cord tensioner of the one or more cord tensioners.

13. A method as claimed in claim 12, further comprising locating the one or more cord tensioners in one of the head rail or the bottom rail.

14. A method as claimed in claim 12, further comprising readjusting the one or more cord tensioners to reset the effective length of the at least one of the lift cords.

15. A method as claimed in claim 12, wherein tensioning the one or more cord tensioners comprises sliding a portion of the one or more cord tensioners along one of the head rail or the bottom rail.

16. A method as claimed in claim 12, further comprising extending the lift cords between a covering operating system and the adjuster, the covering operating system operable to extend or retract the covering.

17. A method as claimed in claim 16, wherein:

the covering operating system comprises a rotatable shaft and pulley system; and the method further comprises wrapping each lift cord about a respective pulley to retract the retractable covering.

* * * * *